United States Patent [19]

Leach et al.

[11] 4,363,014

[45] Dec. 7, 1982

[54] SNAP-ON COVER FOR BOBBIN-WOUND COIL ASSEMBLY

[75] Inventors: Charles W. Leach, Jefferson County; Jerry W. McElroy, St. Louis County, both of Mo.; Donald E. Donnelly, Edwardsville, Ill.

[73] Assignee: Emerson Electric Co., St. Louis, Mo.

[21] Appl. No.: 261,139

[22] Filed: May 6, 1981

[51] Int. Cl.[3] ..... H01F 27/02

[52] U.S. Cl. ..... 336/90; 174/138 F; 336/192; 336/208

[58] Field of Search ..... 336/90, 92, 94, 98, 336/192, 198, 208, 209; 174/135, 138 F

[56] References Cited

U.S. PATENT DOCUMENTS

| | | | |
|---|---|---|---|
| 3,939,450 | 2/1976 | Donnelly | 336/208 |
| 4,000,483 | 12/1976 | Cook et al. | 336/198 X |
| 4,076,364 | 2/1978 | Kuo | 174/135 |

OTHER PUBLICATIONS

"IBM Technical Disclosure Bulletin," Hardardt et al., vol. 5, No. 2, Jul. 1962, pp. 46, 47.

*Primary Examiner*—Thomas J. Kozma
*Attorney, Agent, or Firm*—Paul A. Becker, Sr.

[57] ABSTRACT

A snap-on cover for a bobbin-wound electrical coil assembly includes a plurality of displaceable tabs aligned with slots provided for lead exits in the end flanges of the bobbin. Those tabs aligned with slots containing leads are displaced whereas those tabs aligned with unused slots are not displaced and effectively cover such unused slots.

1 Claim, 14 Drawing Figures

SNAP-ON COVER FOR BOBBIN-WOUND COIL ASSEMBLY

This invention relates to bobbin-wound electrical coil assemblies and particularly to improved snap-on enclosure means therefor.

U.S. Pat. No. 3,939,450, assigned to the assignee of the present invention, discloses several forms of a snap-on cover used in a bobbin-wound electrical coil assembly such as a transformer. As shown therein, the same cover is intended to be used with different bobbins wherein the bobbins differ in the number and location of slots through which insulated lead wires exit.

A disadvantage of the design of the several forms of the snap-on cover in the above-referenced patent is that the covers do not completely cover any unused lead-exit slots. It is considered desirable to cover or enclose such unused slots to ensure that any spark that may occur in the coils of wire on the bobbin does not exit to any surrounding equipment. Such a spark could occur, for example, when the primary coil of a transformer opens due to a shorted secondary coil.

While some manufacturers do provide a snap-on cover construction wherein unused lead-exit slots are covered, a plurality of covers in needed, thus negating the desired feature of using the same cover regardless of the quantity and location of the slots.

It is an object of this invention, therefore, to provide a generally new and improved snap-on cover for a bobbin-wound coil assembly in which the cover is adapted to cover or enclose any unused lead-exit slots in a multi-slotted bobbin.

A further object is to provide a snap-on cover for a bobbin-wound coil assembly having a bobbin with a plurality of lead-exit slots; in which the cover is provided with a plurality of displaceable tabs; in which the tabs are aligned with the bobbin slots; in which the tabs aligned with bobbin slots through which insulated lead wires exit are displaced when the cover is snapped on to the bobbin; and in which the tabs aligned with unused bobbin slots are not displaced when the cover is snapped on to the bobbin so as to effectively cover such unused slots.

Further objects and advantages will become apparent from the following description when read in connection with the accompanying drawings.

DESCRIPTION OF THE PREFERRED EMBODIMENT

Figure 1:
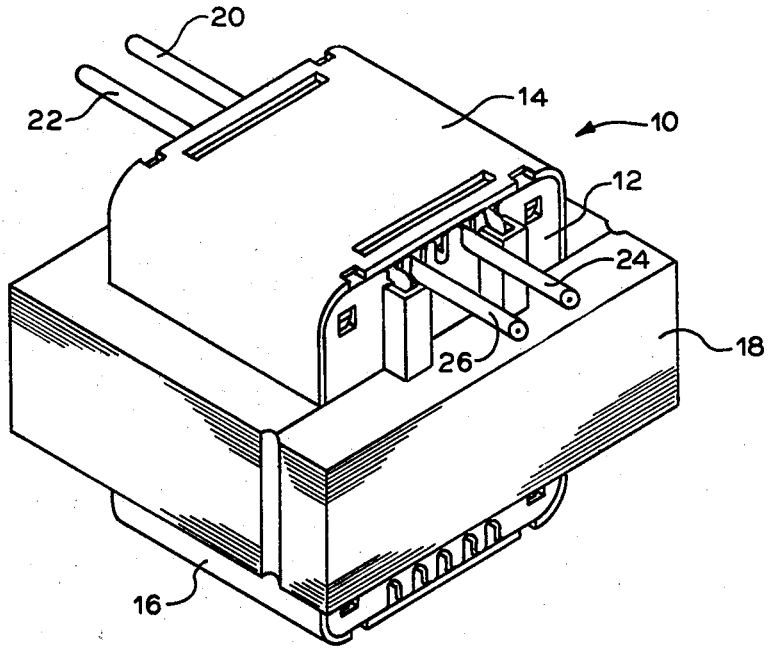
FIG. 1 is a perspective view of a coil assembly constructed in accordance with the present invention.

In the drawings, the invention is illustrated as applied to an electrical coil assembly for use in a small transformer. It will be apparent that the principles of the present invention, which are hereinafter more fully described, may be utilized in various other types of electrical coil assemblies such as those used in inductors, relays, and solenoids.

Referring now to the drawings, there is shown in FIG. 1 a transformer 10 comprising a coil assembly 12, a top cover 14, a bottom cover 16, and a magnetic, laminated-steel core 18. Transformer 10 is adapted to be connected to an alternating current power source by a pair of insulated electrical leads 20 and 22 and to an electrical load by a pair of insulated electrical leads 24 and 26.

Figure 2:
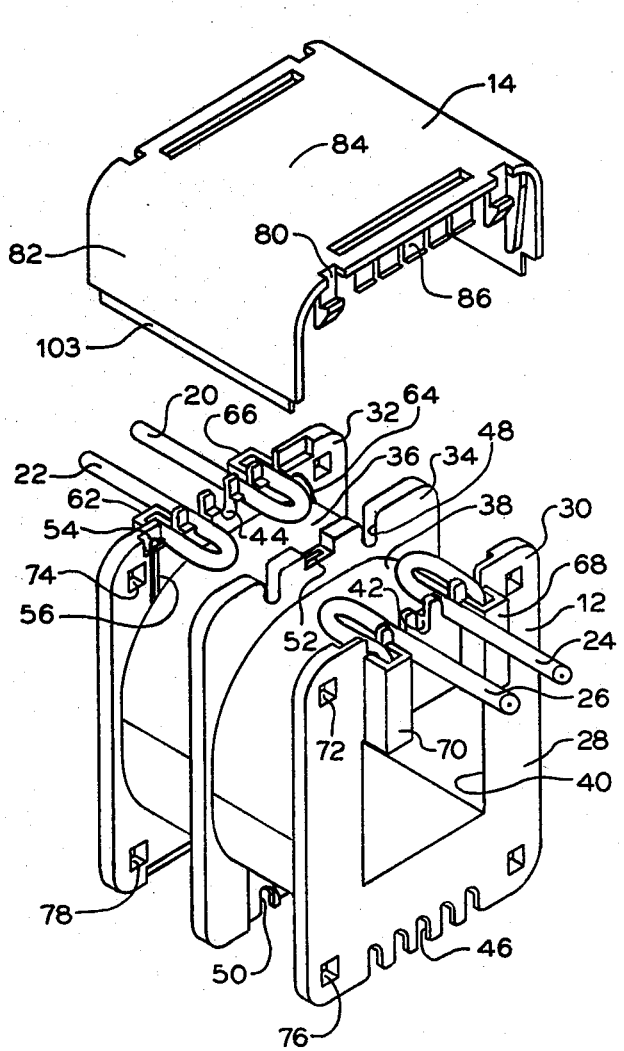
FIG. 2 is a perspective view of the coil assembly of FIG. 1 shown prior to attaching the top snap-on cover and with the magnetic core and the bottom snap-on cover removed.

Referring to FIG. 2, coil assembly 12 includes an insulative bobbin 28 having end flanges 30 and 32 and an intermediate flange 34. A high voltage primary coil 36 is wound on bobbin 28 between flanges 32 and 34, and a low voltage secondary coil 38 is wound between flanges 30 and 34. Bobbin 28 has a through rectangular opening 40 for receiving a center leg of magnetic core 18.

Figure 3:
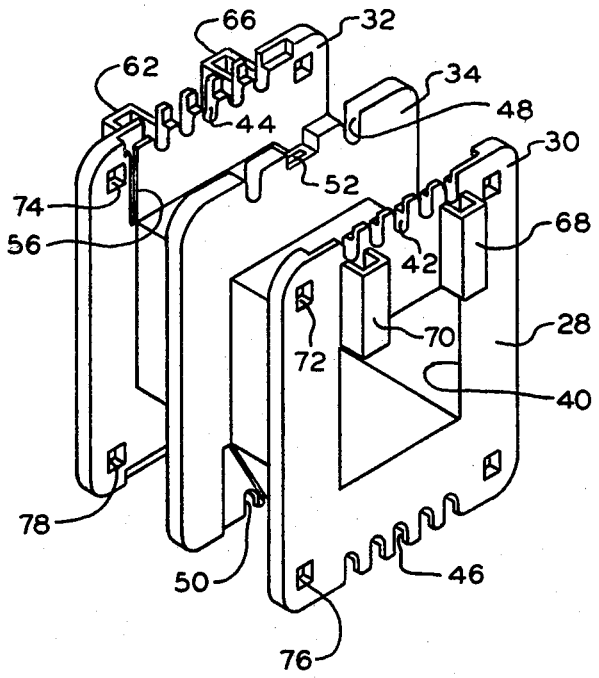
FIG. 3 is a perspective view of the bobbin of FIG. 2.

Referring to FIGS. 2 and 3, end flange 30 is provided with a plurality of lead-exit slots 42 extending radially inwardly from the periphery of the top portion thereof. Slots 42 are narrower than the diameter of insulated leads 24 and 26 so that the insulation thereon is compressed as leads 24 and 26 are forcibly inserted into selected ones of slots 42. The amount of compression is sufficient to enable leads 24 and 26 to resist a considerable pulling force applied parallel to the longitudinal axis of bobbin 28. Top cover 14, as will be described hereinafter, retains leads 24 and 26 within selected ones of slots 42 so as to enable leads 24 and 26 to resist a pulling force applied perpendicular to the longitudinal axis of bobbin 28. Similarly, end flange 32 is provided with a plurality of slots 44 for containing insulated leads 20 and 22 in selected ones thereof.

It is noted that end flange 30 of bobbin 28 is also provided with a plurality of slots 46, similar to slots 42 and 44, in the bottom portion thereof. Similarly, the bottom portion of end flange 32 is also provided with a plurality of similar slots (not shown). Also, intermediate flange 34 is provided with a plurality of similar slots 48 in the top portion thereof and a plurality of similar slots 50 in the bottom portion thereof. Additionally, intermediate flange 34 is provided with a terminal-retaining socket 52 in the top portion and one or more similar sockets in the bottom portion (not shown). Also, bottom portions of end flanges 30 and 32 preferrably are also provided with a plurality of similar sockets (not shown). The advantage of providing bobbin 28 with such a plurality of slots and sockets is to enable using the same bobbin in a wide variety of transformers.

Figure 4:
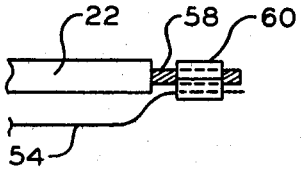
FIG. 4 is an enlarged top plan view of the means for connecting the lead wires and coil ends of FIG. 2 shown prior to insertion thereof into insulative pockets in the bobbin flanges.

The start end 54 of primary coil 36 extends therefrom through a start slot 56 in an inside portion of end flange 32. As illustrated in FIG. 4, start end 54 is connected to a stripped end 58 of insulated lead 22 by a connector 60. Contiguous with one of the slots 44 in end flange 32 is a rectangular, hollow receptacle 62 having an open top end into which connector 60, subsequent to connecting start end 54 and lead 22, is inserted. Lead 22 is thereafter inserted into the slot 44 contiguous with receptacle 62, formed in a U-shaped loop, and inserted into another of the slots 44 so as to extend outwardly from end flange 32.

The finish end 64 of primary coil 36 extends therefrom and is connected in a similar manner to a stripped end of insulated lead 20. Contiguous with another of the slots 44 in end flange 32 is another similar receptacle 66 into which the connected finish end 64 and lead 20 is inserted. Lead 20 is thereafter inserted into the slot 44 contiguous with receptacle 66 and into another of the slots 44 so as to extend outwardly from end flange 32.

In a similar manner, end flange 30 is provided with a receptacle 68, contiguous with one of the slots 42 therein, for receiving the connected start end (not shown) of secondary coil 38 and lead 24, and lead 24 is thereafter inserted into the slot 42 contiguous with receptacle 68 and into another of the slots 42 so as to extend outwardly from end flange 30. Also in a similar manner, a receptacle 70, contiguous with another of the slots 42 in end flange 30, receives the connected finish end (not shown) of secondary coil 38 and lead 26, and lead 26 is thereafter inserted into the slot 42 contiguous with receptacle 70 and into another of the slots 42 so as to extend outwardly from end flange 30.

End flanges 30 and 32 are each provided with a pair of rectangular openings 72 and 74, respectively, on the top portions thereof for receiving, in a snap-on manner, the top cover 14. The bottom portions of end flanges 30 and 32 are similarly provided with openings 76 and 78, respectively, for receiving bottom cover 16.

In transformer 10, covers 14 and 16 are identical. For purposes of describing the cooperation between covers 14 and 16 and coil assembly 12, reference will be made to cover 14.

Figure 5:
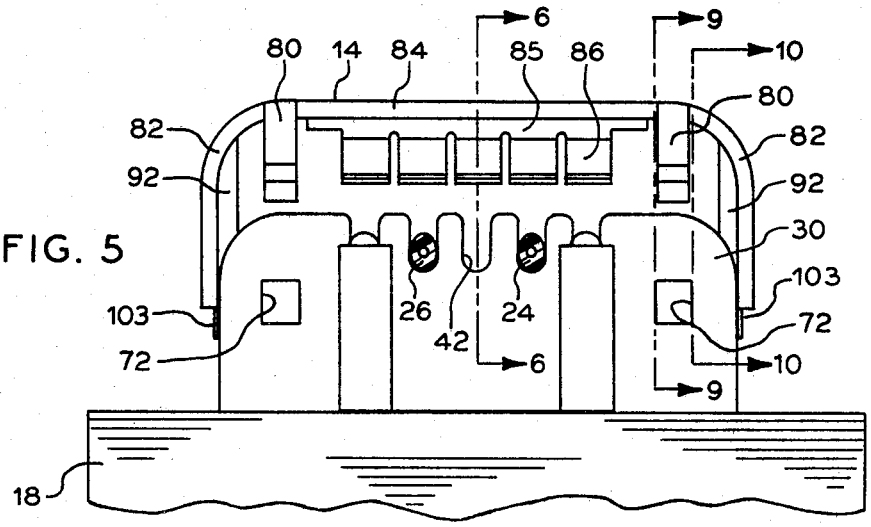
FIG. 5 is a partial front elevation view of the coil assembly of FIG. 1 shown with the top snap-on cover aligned with the bobbin but prior to being attached thereto.

Cover 14 is a U-shaped, relatively rigid member made of a suitable insulating material. Referring to FIGS. 2 and 5, cover 14 includes a pair of flexible latching members or legs 80 spaced inwardly from side walls 82 of cover 14 and projecting downwardly from central portion 84 of cover 14. Latching members or legs 80 are in vertical alignment with openings 72 in end flange 30, as shown in FIG. 5, to enable legs 80 to snap into openings 72. Also projecting downwardly from central portion 84 of cover 14 is a ledge 85, shown in FIG. 5, and a plurality of tabs 86 extending downwardly therefrom, each of the tabs 86 being vertically aligned with a slot 42 of end flange 30. Similarly, as partially shown in FIG. 6, cover 14 is provided with a pair of legs 88 and a plurality of tabs 90 projecting downwardly from a ledge 91, the legs 88 and tabs 90 being in vertical alignment with openings 74 and slots 44, respectively, of end flange 32.

Figure 9:
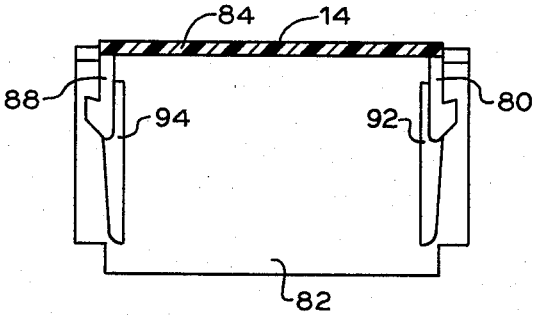
FIG. 9 is an enlarged cross-sectional view of the cover taken along line 9—9 of FIG. 5.
Figure 10:
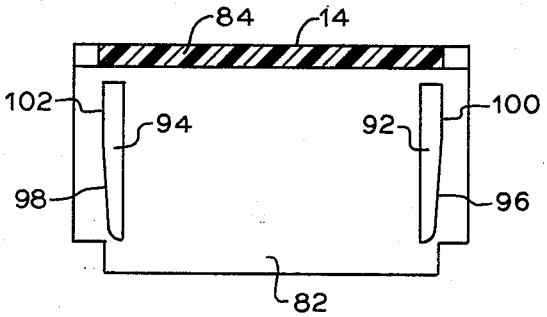
FIG. 10 is an enlarged cross-sectional view of the cover taken along line 10—10 of FIG. 5.
Figure 11:
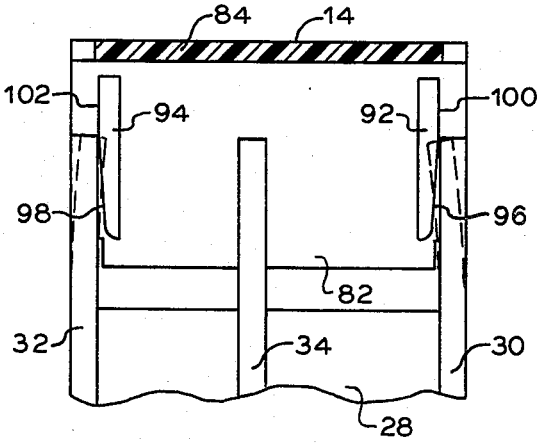
FIG. 11 is an enlarged cross-sectional view similar to FIG. 10 but showing the cooperation of a portion of the bobbin flanges with guide rails on the cover.

Each side wall 82 is provided with a pair of guide rails 92 and 94. Each guide rail 92 and 94 projects inwardly from side walls 82 a small amount, as shown for guide rails 92 in FIG. 5. As shown in FIG. 10, guide rails 92 and 94 have sloping surfaces 96 and 98, respectively, starting at distal portions thereof and sloping outwardly, terminating in flat portions 100 and 102, respectively. As shown more clearly in FIG. 11, guide rails 92 and 94 are effective to initially align cover 14 with bobbin 28 and subsequently to force the top portions of end flanges 30 and 32, respectively, slightly outwardly. Referring to FIG. 9, this slight outward movement of the top portions of end flanges 30 and 32 minimizes the amount that legs 80 and 88 need to deflect inwardly prior to being snapped into openings 72 and 74, respectively. Also, after cover 14 is snapped on to coil assembly 12, the force exerted by guide rails 92 and 94 against end flanges 30 and 32, respectively, is such that, even with a minimum amount of engagement of legs 80 and 88 in openings 72 and 74, respectively, cover 14 is prevented from being easily removed.

Cover 14 is also provided with a thin lip portion 103 extending downwardly from side walls 82, as shown in FIGS. 2 and 5, which is sandwiched between coil assembly 12 and magnetic core 18 when cover 14 is securely attached.

Figure 6:
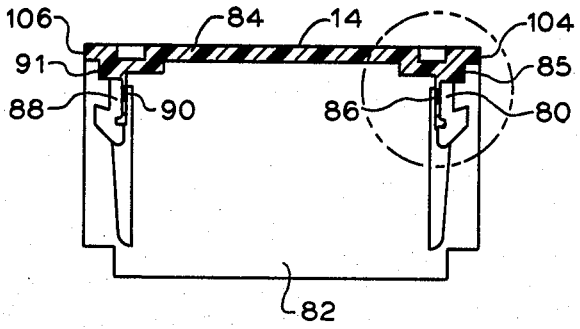
FIG. 6 is an enlarged cross-sectional view of the cover taken along line 6—6 of FIG. 5.

As previously described, legs 80 are in vertical alignment with openings 72, tabs 86 are in vertical alignment with slots 42, legs 88 are in vertical alignment with openings 74, and tabs 90 are in vertical alignment with slots 44. As shown in FIG. 6, legs 80 and tabs 86 are spaced inwardly from an outer edge 104 of the central portion 84 of cover 14, and legs 88 and tabs 90 are spaced inwardly from an opposite outer edge 106 of central portion 84.

As previously described, in the process of attaching cover 14 to coil assembly 12, the guide rails 92 and 94 are effective to force the top portions of bobbin end flanges 30 and 32, respectively, slightly outwardly. Continued movement of the cover 14 toward coil assembly 12 enables the top portions of end flanges 30 and 32 to contact legs 80 and 88, respectively, deflecting them slightly inwardly. Further movement of cover 14 causes displacement of those tabs 86 and 90 which are in vertical alignment with those of the slots 42 and 44, respectively, containing leads 20, 22, 24, and 26, and permits those tabs 86 and 90 which are in vertical alignment with those of the slots 42 and 44, respectively, not containing leads 20, 22, 24, and 26, to remain in an undisplaced position whereby those undisplaced tabs 86 and 90 are sufficiently close to those unused slots so as to effectively cover or enclose them.

Figure 7A:
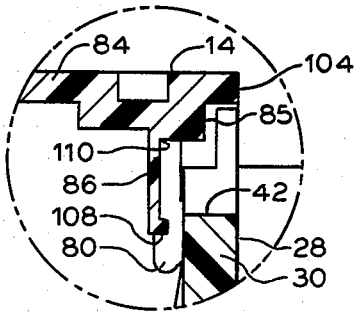
FIG. 7A is an enlarged cross-sectional view similar to FIG. 7, showing the position of a displaceable tab after the cover is attached to the bobbin, wherein the tab is not displaced.
Figure 7:
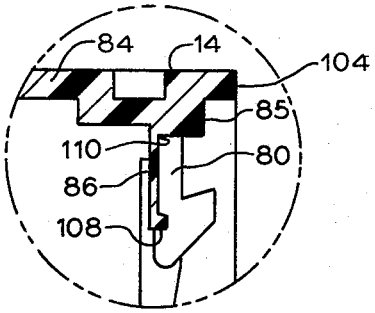
FIG. 7 is an enlarged cross-sectional view of an encircled portion of FIG. 6.
Figure 8:
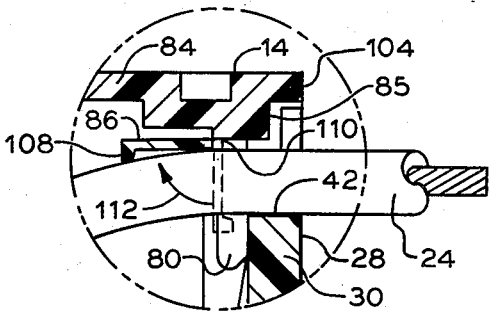
FIG. 8 is an enlarged cross-sectional view similar to FIG. 7A, showing the position of a displaceable tab after the cover is attached to the bobbin, wherein the tab is displaced by a lead wire.

For example, as shown typically for tabs 86 in FIG. 5, such further movement of cover 14 causes those tabs 86 to the left of the center tab to contact lead 26 and those tabs 86 to the right of the center tab to contact lead 24. Since tabs 86 are inwardly spaced from outer edge 104 of central portion 84 of cover 14, such contact with leads 26 and 24 is at points thereon slightly inwardly of end flange 30. As shown more clearly in FIGS. 7, 7A, and 8, tabs 86 are relatively thin members and include a slightly wider free end 108 and a base 110 extending from ledge 85. When those tabs 86 to the right of the center tab, as viewed in FIG. 5, contact lead 24, those tabs 86 are displaced. The displacement occurs in the direction of arrow 112 in FIG. 8, and results in those tabs 86 being bent or broken at their bases 110. The center one of tabs 86, as viewed in FIG. 5, is not displaced since its aligned one of slots 42 is unused. As shown more clearly in FIG. 7A, this center one of tabs 86 is sufficiently close to its aligned one of slots 42 so as effectively enclose or cover it.

In a similar manner, those tabs 86 to the left of the center tab, as viewed in FIG. 5, are displaced due to contact with lead 26. Also in a similar manner, those of the tabs 90 which contact leads 20 and 22 are displaced, and the center one of tabs 90 remains undisplaced.

Finally, further movement of cover 14 enables legs 80 and 88 to snap into openings 72 and 74, respectively, securing cover 14 to coil assembly 12. With cover 14 secured, leads, 20, 22, 24 and 26 are retained in selected ones of slots 44 and 42. This retention, in combination with the compression of the insulation of leads 20, 22, 24, and 26 within slots 44 and 42, ensures that a pulling force applied in any direction on the leads is not transmitted to the connections of the leads and coil ends of coils 36 and 38.

Cover 16 is attached in a similar manner. Since there are no leads exiting from the bottom portions of end flanges 30 and 32, none of the tabs of cover 16 are displaced.

A particular advantage of the above described displaceable tabs is that the same cover can be used on a wide variety of coil assemblies. For example, it should be evident that the same covers 14 and 16 could be used with a coil assembly the same as that of FIG. 2 except with an additional lead that would be secured in slot 52 of intermediate flange 34 and which lead would exit through either one of the unused one of slots 42 or 44 in end flanges 30 and 32, respectively. Also, it should be evident that the same covers 14 and 16 can be used with bobbins which are the same as bobbin 28 except for the location of one or more of the receptacles 62, 66, 68, and 70. That is, regardless of the location of receptacles 62, 66, 68, and 70, and of leads 20, 22, 24, and 26, and of any additional lead, those tabs 86 and 90 aligned with slots containing the leads will be displaced, and those tabs 86 and 90 aligned with slots not used will remain in an undisplaced position so as to cover or enclose such unused slots. Also, the same covers 14 and 16 can be used with bobbins without such receptacles, such as the bobbin shown in FIG. 12.

Figure 12:
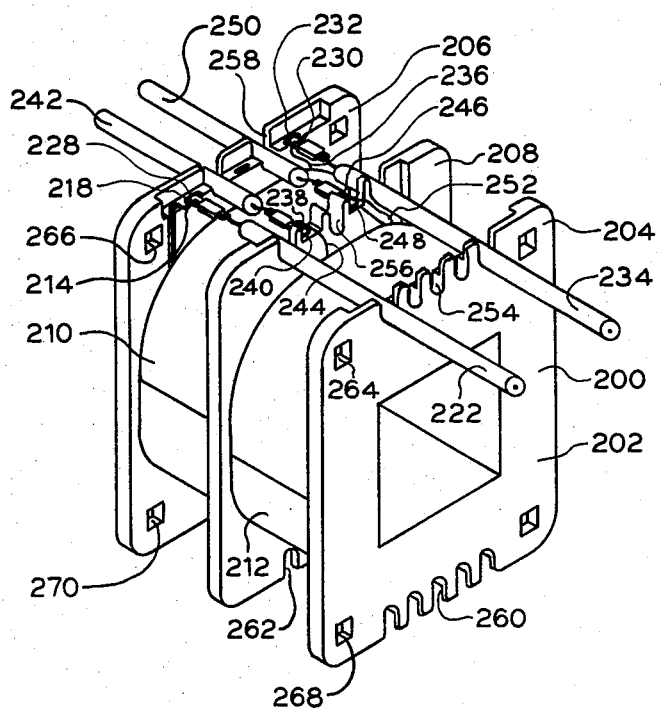
FIG. 12 is a perspective view of a coil assembly using a bobbin somewhat different from that of FIG. 3 and shown with the snap-on covers removed.

Briefly, FIG. 12 illustrates a coil assembly 200 including an insulative bobbin 202 having end flanges 204 and 206 and an intermediate flange 208. A primary coil 210 is wound on bobbin 202 between flanges 206 and 208, and a secondary coil 212 is wound between flanges 204 and 208.

Figure 13:
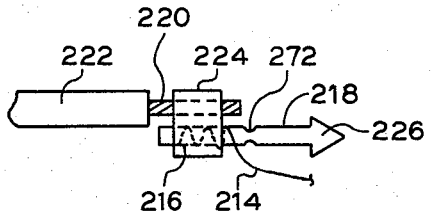
FIG. 13 is an enlarged top plan view of the means for connecting the lead wires, coil ends, and terminals of FIG. 12 shown prior to insertion of the terminals into sockets in the bobbin flanges.

A start end 214 of primary coil 210 is wrapped around the shank 216 of a terminal 218 as shown in FIG. 13, and the wrapped connection is connected to a stripped end 220 of an insulated lead 222 by a connector 224. A barbed end 226 of terminal 218 secures terminal 218 in a socket 228 in the inside surface of end flange 206. In a similar manner, a terminal 230 is secured in a socket 232 in end flange 206 and connects a lead 234 with a finish end 236 of primary coil 210.

Also in a similar manner, a terminal 238 is inserted into a socket 240 in the periphery of intermediate flange 208 and connects a lead 242 with a finish end 244 of secondary coil 212, and a terminal 246 is inserted into a socket 248 of intermediate flange 208 and connects a lead 250 with a start end 252 of secondary coil 212.

The top portion of end flange 204 is provided with a plurality of lead-exit slots 254 similar to previously described slots in bobbin 28. Similarly, the top portion of intermediate flange 208 is provided with slots 256 and the top portion of end flange 206 is provided with slots 258. Additionally, the bottom portion of end flange 204 is provided with slots 260, the bottom portion of intermediate flange 208 is provided with slots 262, and the bottom portion of end flange 206 is provided with similar slots (not shown).

The top portions of end flanges 204 and 206 are each provided with a pair of rectangular openings 264 and 266, respectively, for accepting legs 80 and 88 of top cover 14. The bottom portions of end flanges 204 and 206 are each provided with a similar pair of rectangular openings 268 and 270, respectively, for accepting bottom cover 16.

Terminal 218 is bent at a relatively thin intermediate portion 272, shown in FIG. 13, and lead 222 is subsequently forcibly inserted into one of the slots 256 in intermediate flange 208 and one of the slots 254 in end flange 204. Similarly, terminal 230 is bent and lead 234 is inserted into one of the slots 256 and one of the slots 254. Also, terminal 238 is bent and lead 242 is inserted into one of the slots 258 in end flange 206, and terminal 246 is bent and lead 250 is inserted into one of the slots 258.

When cover 14 is snapped on to coil assembly 200, those of tabs 86 which contact leads 222 and 234 will be displaced, with the remaining ones of tabs 86 being undisplaced. Those of tabs 90 which contact leads 242 and 250 and terminals 218 and 230 will be displaced, with the remaining one of tabs 90 being undisplaced. It is noted that the remaining undisplaced tab 90 is redundant in that there is no specific opening that this undisplaced tab 90 covers. However, undisplaced ones of tabs 86 cover those of slots 254 in end flange 204 which are unused.

It is noted that it is preferable that the displaceable tabs be displaced in the process of attaching covers 14 and 16. However, it should be evident that the appropriate tabs could be displaced prior to assembly of covers 14 and 16 if desired.

While the invention has been illustrated and described in detail in the drawings and foregoing description, it will be recognized that many changes and modifications will occur to those skilled in the art. It is therefore intended, by the appended claims, to cover any such changes and modifications as fall within the true spirit and scope of the invention.

We claim:

1. In a bobbin-wound electrical coil assembly having a plurality of lead-exit slots in one or both of the bobbin end flanges, some of the slots containing insulated electrical leads and others of the slots being unused, the slots being narrower than the diameter of the insulated leads so that the insulation on the leads is compressed as the leads are inserted into those slots being used so as to enable the leads to resist a pulling force applied thereto, an improved cover therefor comprising:

a relatively rigid U-shaped member comprising a central portion and side walls integral with said central portion and extending downwardly therefrom;

a plurality of flexible legs extending downwardly from said central portion and cooperative with leg-retaining openings in the bobbin end flanges for providing snap-on engagement between the cover and said bobbin end flanges, said legs being adapted to be deflected inwardly by said bobbin end flanges prior to said engagement;

a plurality of tabs extending downwardly from said central portion and spaced inwardly from an outer edge thereof so as to be in alignment with the bobbin end flange slots inwardly of said bobbin end flanges;

those of said tabs aligned with the slots containing leads being displaced when said cover is snapped on to said bobbin end flanges, said cover being effective to retain said leads in said slots containing leads;

those of said tabs aligned with the unused slots being undisplaced and effective to cover said unused slots;

each of said side walls including guide rails cooperative with said bobbin end flanges for initially aligning said cover with said bobbin end flanges and for subsequently applying an outward force to portions thereof; and said outward force being effective, prior to said engagement, for minimizing the amount of said inward deflection of said flexible legs and, after engagement, for preventing said cover from being easily removed in the event of a minimum amount of engagement of said flexible legs in said leg-retaining openings.

* * * * *